US007579933B2

(12) United States Patent
Weber et al.

(10) Patent No.: US 7,579,933 B2
(45) Date of Patent: Aug. 25, 2009

(54) ELECTRICAL INSTALLATION SWITCHING DEVICE

(75) Inventors: Ralf Weber, Heidelberg (DE); Jürgen Christmann, Neckarsteinach (DE); Klaus-Peter Eppe, Waldbrunn (DE); Peter Pfirrmann, Essingen/Pfalz (DE)

(73) Assignee: ABB Patent GmbH, Ladenburg (DE)

( * ) Notice: Subject to any disclaimer, the term of this patent is extended or adjusted under 35 U.S.C. 154(b) by 12 days.

(21) Appl. No.: 11/667,730

(22) PCT Filed: Nov. 8, 2005

(86) PCT No.: PCT/EP2005/011910

§ 371 (c)(1),
(2), (4) Date: May 15, 2007

(87) PCT Pub. No.: WO2006/053648

PCT Pub. Date: May 26, 2006

(65) Prior Publication Data

US 2008/0001687 A1 Jan. 3, 2008

(30) Foreign Application Priority Data

Nov. 18, 2004 (DE) ..... 10 2004 055 564

(51) Int. Cl.
*H01H 75/00* (2006.01)
*H01H 77/00* (2006.01)
*H01H 83/00* (2006.01)
*H01H 73/02* (2006.01)

(52) U.S. Cl. ..... 335/6; 200/401; 335/21

(58) Field of Classification Search ..... 335/6, 335/21, 166, 172, 23–25
See application file for complete search history.

(56) References Cited

U.S. PATENT DOCUMENTS 2,941,058 A * 6/1960 Norden ..... 337/59
3,950,714 A * 4/1976 Mrenna et al. ..... 335/35
4,023,127 A * 5/1977 Mune ..... 335/172

(Continued)

FOREIGN PATENT DOCUMENTS

DE 43 13 207 A1 10/1994

(Continued)

OTHER PUBLICATIONS

International Search Report.

(Continued)

*Primary Examiner*—Elvin G Enad
*Assistant Examiner*—Alexander Talpalatskiy
(74) *Attorney, Agent, or Firm*—Buchanan Ingersoll & Rooney PC

(57) ABSTRACT

The disclosure relates to an electrical installation switching device, having a switching mechanism with a latching point which can be unlatched manually by means of a switching toggle or by means of an electromagnetic or thermal release, having a tripping lever which can be operated by the electromagnetic and thermal release and acts on the latching point, having a latching lever which forms one element of the latching point, and having a movable contact lever, which can pivot, is acted on by the electrical release in the event of a short-circuit and is moved permanently to the disconnected position by the switching mechanism in the event of a short-circuit or overcurrent. The latching lever (which is mounted in the enclosure such that it can rotate) together with the tripping lever forms the latching point. The tripping lever is mounted such that it can rotate on the same rotation axis as the switching toggle. A projection which holds a first limb of a U-bracket is integrally formed on the switching toggle, diametrically opposite the switching handle, and its other, second limb is guided such that it can move in an elongated hole in the elongated latching lever and is connected in an articulated manner to a connecting lug, whose other end is connected to the contact lever, which is mounted such that it can rotate.

13 Claims, 5 Drawing Sheets

U.S. PATENT DOCUMENTS

Figure 1:
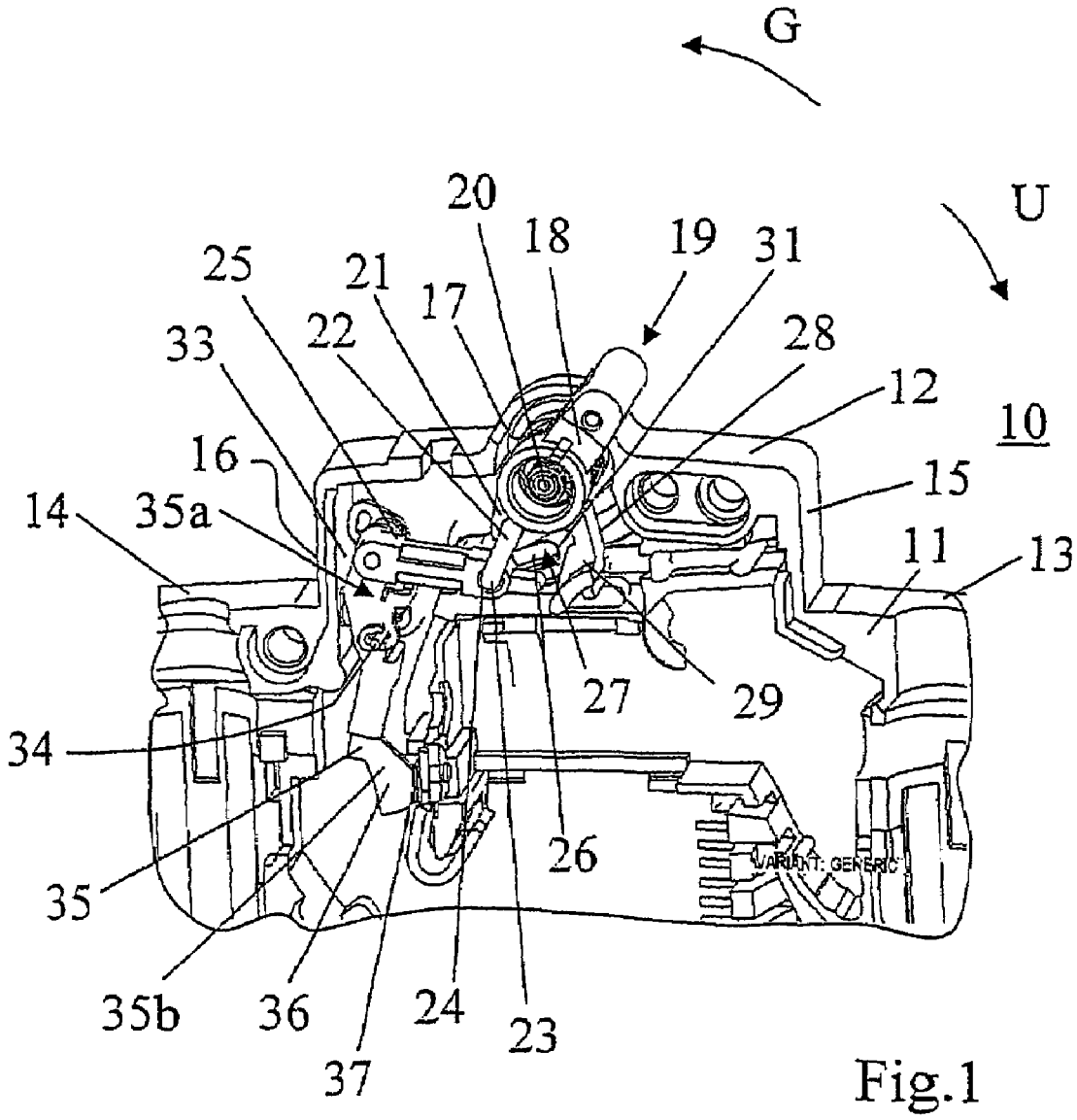

| | | | | | |
|---|---|---|---|---|---|
| 4,079,345 | A | * | 3/1978 | Pietsch | 335/10 |
| 4,156,219 | A | * | 5/1979 | Coleman | 335/175 |
| 4,222,019 | A | * | 9/1980 | Rusch | 335/6 |
| 4,417,222 | A | * | 11/1983 | Schmitt et al. | 335/6 |
| 4,595,895 | A | * | 6/1986 | Fujii et al. | 335/26 |
| 4,609,799 | A | * | 9/1986 | Ohishi et al. | 200/401 |
| 4,687,891 | A | * | 8/1987 | Bartolo et al. | 200/560 |
| 4,714,907 | A | * | 12/1987 | Bartolo et al. | 335/45 |
| 4,740,770 | A | * | 4/1988 | Lazareth et al. | 335/171 |
| 4,743,878 | A | * | 5/1988 | Ohishi et al. | 335/172 |
| 4,879,535 | A | * | 11/1989 | Mori et al. | 335/14 |
| 4,897,625 | A | * | 1/1990 | Yokoyama et al. | 335/14 |
| 4,916,420 | A | * | 4/1990 | Bartolo et al. | 335/172 |
| RE33,400 | E | * | 10/1990 | Fujii et al. | 335/26 |
| 5,003,139 | A | * | 3/1991 | Edds et al. | 200/401 |
| 5,162,765 | A | * | 11/1992 | DiVincenzo et al. | 335/175 |
| 5,294,901 | A | * | 3/1994 | Tacinelli et al. | 335/35 |
| 5,565,828 | A | * | 10/1996 | Flohr | 335/172 |
| 5,990,434 | A | * | 11/1999 | Fujihira et al. | 200/401 |
| 6,107,902 | A | * | 8/2000 | Zhang et al. | 335/17 |
| 6,262,643 | B1 | * | 7/2001 | Lassalle | 335/21 |
| 6,414,575 | B1 | * | 7/2002 | Swift | 335/6 |
| 6,492,607 | B2 | * | 12/2002 | Bruckert et al. | 200/401 |
| 6,667,680 | B1 | * | 12/2003 | Gibson et al. | 336/172 |
| 6,924,720 | B2 | * | 8/2005 | Miura et al. | 335/165 |
| 7,009,129 | B2 | * | 3/2006 | Vierling | 200/400 |
| 7,115,829 | B2 | * | 10/2006 | Schmid | 200/400 |
| 7,132,911 | B2 | * | 11/2006 | Chung et al. | 335/6 |
| 7,132,912 | B2 | * | 11/2006 | Busenhart | 335/6 |
| 2002/0196108 | A1 | * | 12/2002 | Millburn et al. | 335/6 |
| 2007/0046404 | A1 | * | 3/2007 | Christmann et al. | 335/35 |

FOREIGN PATENT DOCUMENTS

| | | | | |
|---|---|---|---|---|
| DE | 101 24 353 | A1 | | 12/2002 |
| DE | 10 2004 012 919 | A1 | | 10/2005 |
| EP | 0 144 799 | A2 | | 6/1985 |
| EP | 710973 | A1 | * | 5/1996 |
| FR | 2 628 261 | A | | 9/1989 |
| WO | WO 94/17545 | A | | 8/1994 |

OTHER PUBLICATIONS

German Search Report.

* cited by examiner

ELECTRICAL INSTALLATION SWITCHING DEVICE

The invention relates to an electrical service switching device.

The invention relates in particular to the switching mechanism for an electrical service switching device such as this.

A service switching device of the type mentioned initially has been proposed in patent application 10 2004 012919.3 dated Mar. 17, 2004.

The object of the invention is to even further improve an electrical service switching device of the type mentioned initially.

According to the invention, the latching lever (which is mounted in the enclosure such that it can rotate) together with the tripping lever forms the latching point, in that the tripping lever is mounted such that it can rotate on the same axis as the switching toggle. A projection which holds a first limb of a U-shapped bracket is integrally formed on the switching toggle, diametrically opposite the switching handle, and its other limb is guided such that it can move in an elongated hole in the elongated latching lever and is connected in an articulated manner to a connecting lug, whose other end is connected to the contact lever, which is mounted such that it can rotate.

The particular advantage of the present invention is that the number of parts which form the switching mechanism is small by virtue of the design, in particular having fewer parts than the switching mechanism according to the patent application cited above, and, furthermore, it can also be produced simply by fitting it directly into the circuit breaker enclosure.

Since the lug and the tripping lever are produced from a plastic, there is no potential on the switching-handle area.

A further advantageous refinement of the invention consists in that the latching lever runs approximately parallel to the connecting lug and alongside it, with the connecting lug together with the latching lever forming an obtuse angle which is open in the direction of the front face, only in the connected state, and with the connecting lug being moved approximately parallel to the latching lever and approximately parallel to the front face in the direction of the latching point during a disconnection switching operation.

A further advantageous arrangement may consist in that the latching lever is mounted in the enclosure such that it can rotate, at its opposite end to the latching point.

This means that the tripping behavior is reproducible, because of the simple installation process.

In one advantageous refinement, the latching lever is mounted in only one enclosure half-shell, and to this extent is a simple refinement.

In order to improve the mounting, the latching lever can be guided by the lug, and can be held in the bearing point in the enclosure half-shell.

Since a projection is integrally formed on each of the two sides of the latching lever, and is used for mounting it in the two enclosure half-shells, this results in the latching lever being mounted symmetrically, thus reliably avoiding any rotation transversely with respect to the rotation axis of the bearing point.

In order that this can be achieved, the lug has an aperture through which one of the projections on the latching lever passes.

Further advantageous refinements of the invention can be found in the further dependent claims.

Figure 2:
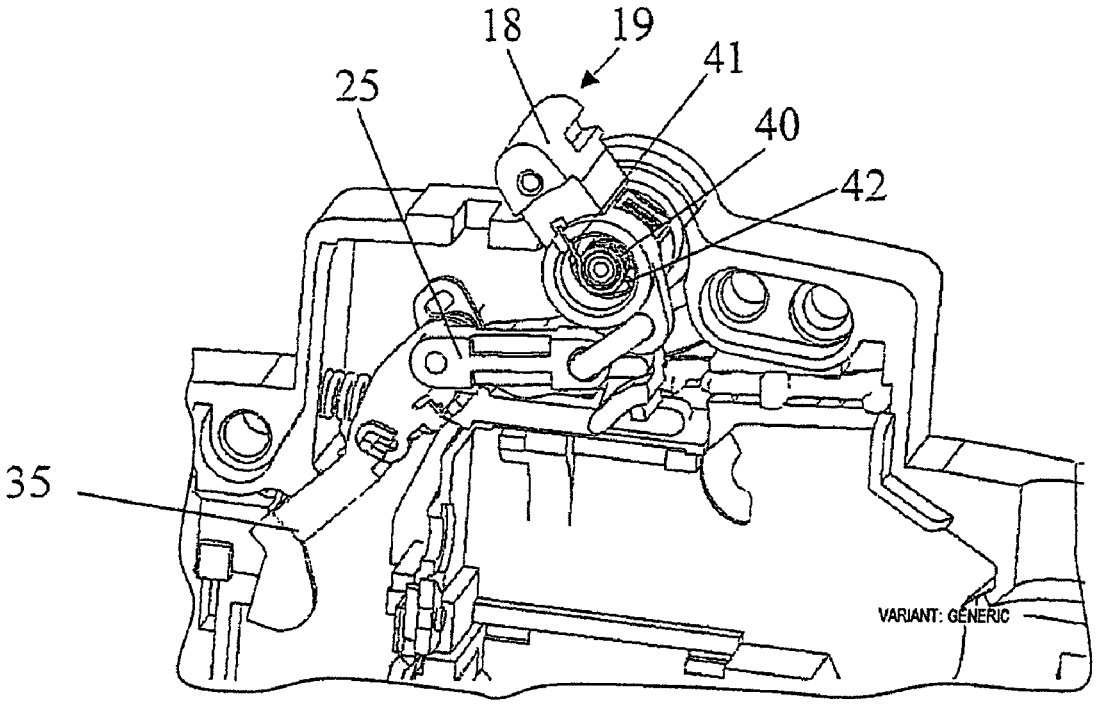
Figure 3:
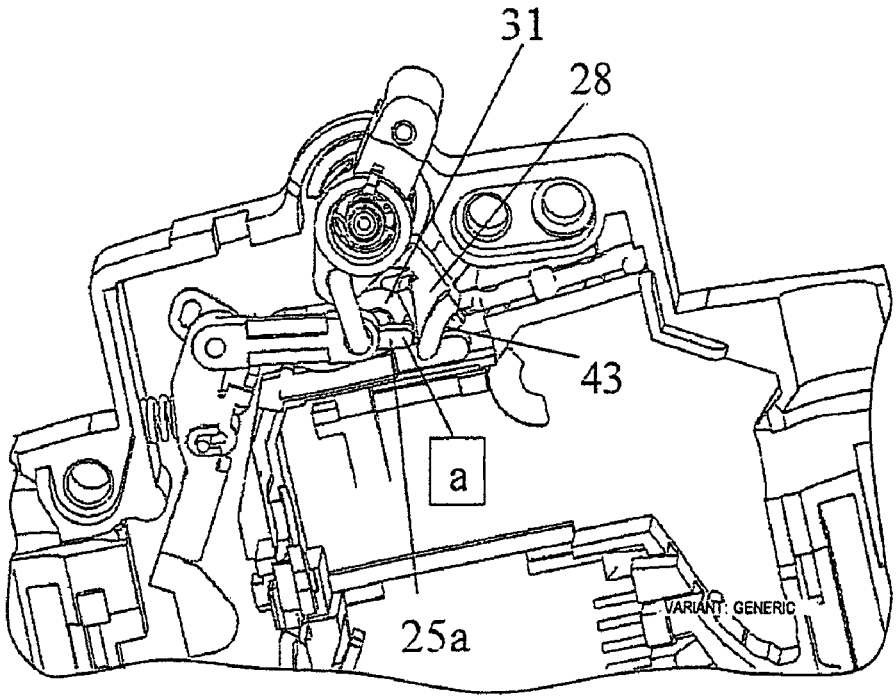
Figure 4:
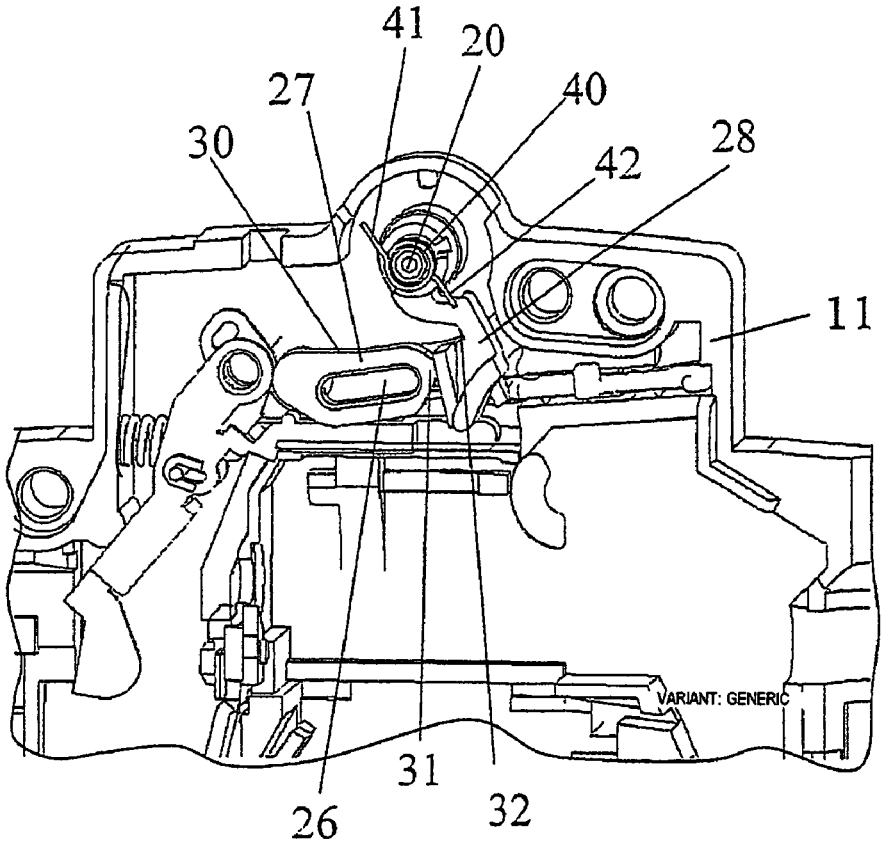
Figure 5:
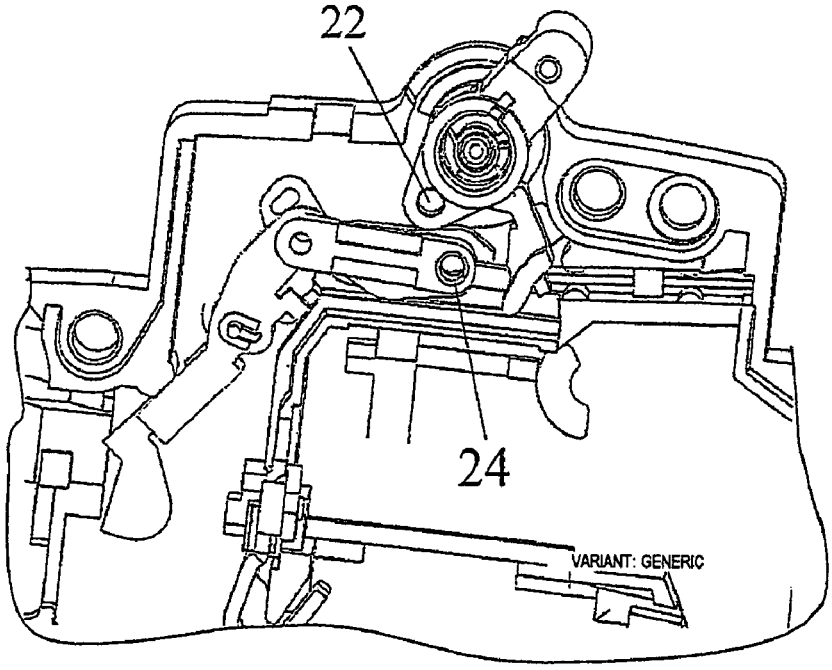
Figure 6:
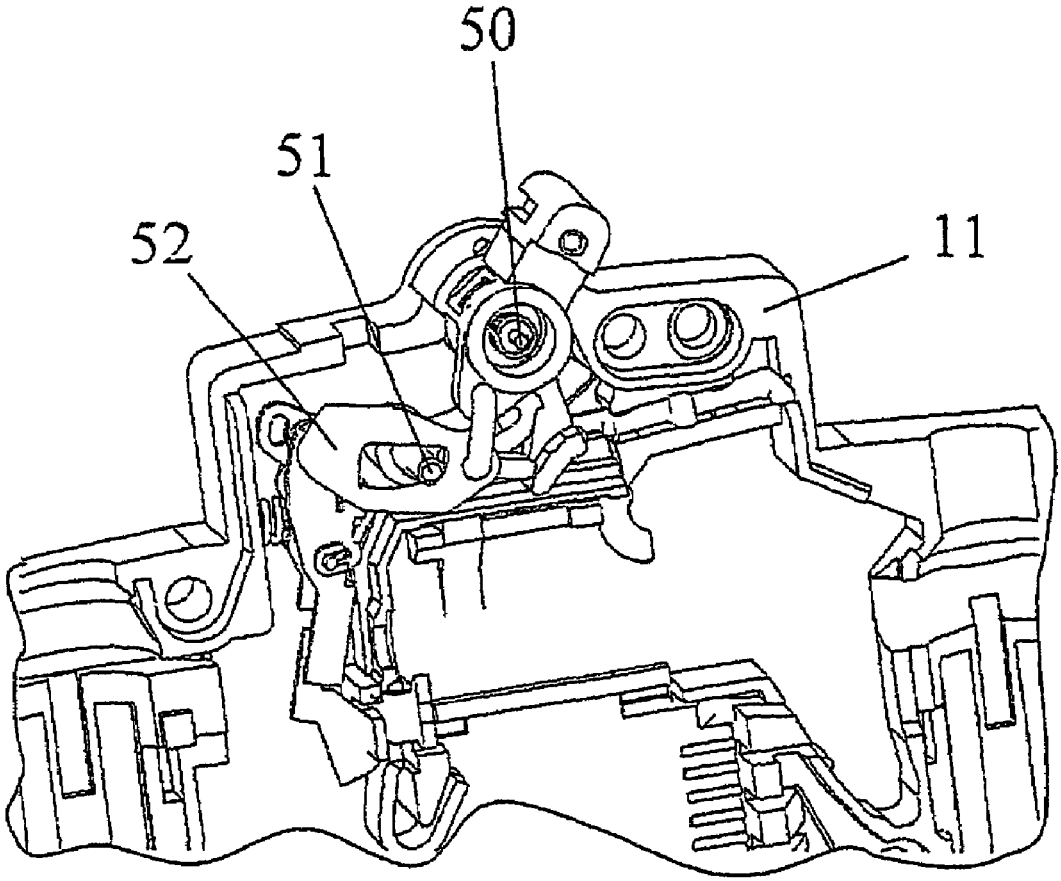
Figure 7:
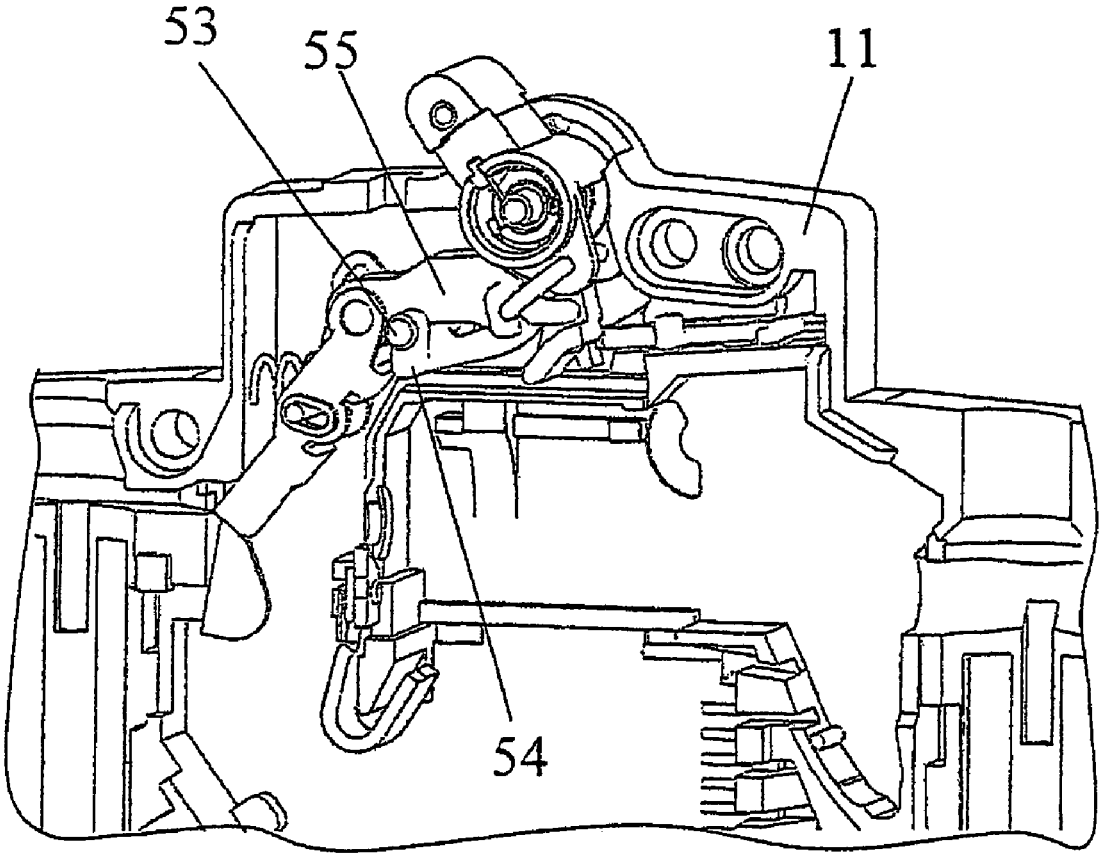

The invention as well as further advantageous refinements and improvements, and further advantages, will be explained and described in more detail with reference to the drawing, in which a number of exemplary embodiments of the invention are illustrated, and in which:

FIG. 1 shows a view into an electrical circuit breaker, in perspective form, in the connected position, FIG. 2 shows the circuit breaker as shown in FIG. 1, in the disconnected position, FIG. 3 shows the circuit breaker as shown in FIGS. 1 and 2, in the so-called free-tripping position, FIG. 4 shows the circuit breaker as shown in FIGS. 1 to 3 in an intermediate assembly step, FIG. 5 shows the circuit breaker as shown in FIG. 4, in a further assembly step, FIG. 6 shows a further embodiment of the invention, and FIG. 7 shows a third refinement of a circuit breaker.

Reference will now be made to FIG. 1.

A circuit breaker which is annotated in its totality with the reference number 10 has an enclosure which is formed from two enclosure half-shells, of which only the first enclosure half-shell 11 is illustrated. Like the complementary enclosure half-shell, this enclosure half-shell 11 has a front front wall 12 as well as two rear front walls 13 and 14, which are connected to one another by means of front narrow-face walls 15 and 16. FIG. 1 does not clearly show rear narrow-face walls associated with these; and they also have nothing to do with the invention.

It is, of course, also possible to use only one enclosure half-shell, which is closed by means of a cover. In the situation in which two enclosure half-shells are provided, each enclosure half-shell has a width which corresponds to half the module width; in the situation in which the enclosure half-shell is closed by means of a cover, the enclosure half-shell is correspondingly of a size which is chosen such that, together with the cover, it matches the module width.

Located in the front front wall 12 there is an opening 17 through which the switching handle 18 of a switching toggle 19 projects, which is mounted in the enclosure such that it can rotate about a shaft 20 which runs at right angles to the inner surface of the enclosure half-shell 11. A projection 21 with an opening 22 in the shape of an eye is located on the diametrically opposite side of the shaft 20 to the switching handle 18, with the longitudinal center axis of the switching handle 18 passing through the center point of the shaft 20 and of the opening 22. One limb (without any reference symbol) of a bracket 23 which is curved in a U-shape engages in the opening 22, while the other limb of the U-shaped bracket engages in a hinge opening 24 in a lug 25. The limb which passes through the hinge opening 23 is designed to be longer than the other limb which is inserted into the hole 22, so that this limb (not illustrated) engages in an elongated hole 26 in a latching lever 27 which is arranged behind the lug, that is to say between the lug 25 and the inner surface of the enclosure half-shell 11. The two limbs of the U-shaped bracket 23 run at right angles to the inner surface of the enclosure half-shell 11, in the direction of the enclosure half-shell 11.

A tripping lever 28 is mounted such that it can rotate about the shaft 20 and has a projection 29 which, in the connected state, runs approximately at right angles to the front front wall 12. In the connected position, the latching lever 27 runs approximately parallel to the front front wall 12, and the lug 25 also runs in the same manner approximately parallel to the front front wall 12, with an obtuse angle being formed between the two of them in the connected state, and with this angle being open to the front front wall 12. The obtuse angle is approximately 180°.

In the connected state, see FIG. 1, the web of the bracket 23 runs at an acute angle to the connecting line V between the shaft 20 and the center point of the opening 22, with the resultant obtuse angle being open between the two towards the latching point (see further below), as a result of which the bracket 23 and the switching toggle are located in a first, stable position.

Reference will now be made to FIG. 4.

This shows an assembly step in which the latching lever 27 and the tripping lever 28 have been inserted into the enclosure half-shell 11. The latching lever 27 is mounted at 30 at one of its ends such that it can rotate, and at its opposite end has a tab 31 which engages behind a step 32 on the tripping lever 28. As can be seen from FIG. 4, the rotation point 30 of the latching lever 27 is arranged in the direction of the contact point (see further below), while in contrast the tab 31 points towards the tripping lever 28 and is located in an area which is closer to the shaft 20.

As can be seen from FIG. 1, in the latched state, the tab 31 rests on the step 32; the tab 31 together with the step 32 thus forms a latching point. The opposite end of the lug 25 to the opening 24 is connected in an articulated manner via a pin 33 (which is not illustrated in any more detail) to a contact lever 35 which can pivot about a fixed-position shaft 34 and at the free end of which contact lever, which runs approximately at right angles to the front front surface 12, a moving contact piece 36 is integrally formed, which, together with a stationary contact piece 37, forms the contact point of the circuit breaker 10. The contact lever 35 is a sort of double-armed lever; the first arm 35*a*, in this case the shorter arm, is connected in an articulated manner to the lug 25, and the moving contact piece 26 is fitted to the other arm 35*b*.

The contact lever 35, which can pivot, runs approximately at right angles to the lug 25 in the connected state, approximately parallel to the web of the bracket 23, and at an angle of about 90° to the front wall. That arm on which the moving contact piece 36 is located projects in the direction of the mounting plane on the circuit breaker, which is opposite the front wall 12.

If tripping now takes place by means of a release, for example a thermal release or an electromagnetic release, then the tripping lever 28 is pivoted in the counterclockwise sense in the direction of the arrow G, as a result of which the tab 31 is released from the step 32, and the latching lever 27 can pivot in the clockwise sense, in the direction of the arrow U, so that, as can be seen in FIG. 2, the longer limb of the U-shaped bracket 23 can move within the elongated hole 26 in the direction of the latching point, so that, during this process, the switching handle 18 and the switching toggle 19 move to the disconnected position, rotating in the counterclockwise sense in the direction of the arrow G, with the lug 25 being released in the process, so that a spring force is exerted on the contact lever 35, and the contact lever 35 can be pivoted about its shaft 34 in the clockwise sense U.

In order to move the switch back to the connected position, the switching handle 18 is pivoted in the clockwise sense U, thus resulting in the U-shaped bracket 23, whose limb is guided by the elongated hole 26 in the lug 27, being moved in the direction of the bearing point of the latching lever, so that the contact lever 35 is also pressed via the lug 25 to the connected position. This is done because the tripping lever is moved to the latched position, and is thus held firmly, by means of a spring arrangement 40 with two projecting arms 41 and 42, of which the arm 41 acts on the switching toggle and the arm 42 acts on the tripping lever, so that the longer limb of the bracket is positively guided. The longer limb is that which does not pass through the opening 22 on the eye 21 of the switching toggle 18.

FIG. 3 shows the circuit breaker or the switching mechanism in the so-called free-tripping position, that is to say in a position in which the tripping lever 28 is pivoted to the tripped position, so that the tab 31 on the latching lever 27 cannot engage behind the step 32 on the tripping lever.

An impact stud 25*a* is located on the extension of the lug 25 and projects against a step 43 on the tripping lever 28; during disconnection, this projection 25*a* acts on the tripping lever 28, so that it is moved to a position which is beyond the position produced by the thermal or magnetic release, so that the tripping lever of a circuit breaker arranged adjacent to it (in the case of a multipole embodiment) can be operated reliably by the tripping lever, by means of a coupling device which is not illustrated in any more detail.

FIG. 4 shows the assembly step in which the latching lever 27 as well as the tripping lever and the moving contact lever have been inserted into the enclosure half-shell 11; FIG. 5 shows a further assembly step, in which the lug has additionally been fitted; the bracket 23 is inserted in an even later assembly step, with one of its limbs being pushed through the opening 22, and its other limb being pushed through the opening 24 as well as the elongated hole 26. This allows the switching mechanism of the circuit breaker to be inserted in a simple manner into the enclosure half-shell 11, at right angles to the surface of the latter's broad face, thus considerably simplifying automatic manufacture.

FIGS. 6 and 7 each show one further embodiment of the invention; in the embodiments shown in FIGS. 1 to 5, the latching lever is mounted only in one of the enclosure half-shells 11; if the latching lever is intended to be mounted in both enclosure half-shells, then a pin is integrally formed on both sides of the latching lever; that pin which is intended to be mounted in the enclosure shell part that is not illustrated is annotated with the reference number 50 in FIG. 6. This pin 50 passes through an opening 51 in a lug 52, whose effect corresponds to that of the lug 25.

In the embodiment shown in FIG. 7, a pin 53 which corresponds to the pin 51 is integrally formed on the tripping lever and is mounted in the enclosure shell that is not illustrated. In this case, the pin 53 is integrally formed on a step 54 which runs approximately at right angles to the longitudinal extent. A lug 55 which corresponds to the lug 51 but has no aperture 52 is then at least partially covered by the step 54, so that the lug 55 is essentially located above the connecting line between the pin 53 and the pin which cannot be seen in FIG. 7, which is then mounted in the enclosure half-shell 11.

The invention claimed is:

1. An electrical service switching device, comprising:

a switching mechanism with a latching point which can be unlatched manually by a switching toggle or by an electromagnetic or thermal release the switching toggle including a switching handle;

a tripping lever operable by the electromagnetic or thermal release, the tripping lever interacting with a rotatable latching lever which forms one element of the latching point; and a movable contact lever, which pivots, is acted on by the electromagnetic or thermal release in the event of a short-circuit and is moved to a disconnected position by the switching mechanism in the event of a short-circuit or overcurrent;

wherein the latching lever together with the tripping lever forms the latching point, the tripping lever is mounted such that it rotates on the same rotation axis as the switching toggle, a projection which holds a first limb of a U-bracket is integrally formed on the switching toggle, opposite the switching handle, and a second limb of the U-bracket is guided such that it can move in an elongated hole in the latching lever and is connected in an articulated manner to a connecting lug, whose other end is connected to the contact lever, and wherein the latching lever runs approximately parallel to the connecting lug and alongside it, the connecting lug together with the latching lever forming an obtuse angle which is open in the direction of a front face of the switching device, only in a connected state, and the connecting lug being moved approximately parallel to the latching lever and approximately parallel to the front face in the direction of the latching point during a disconnection switching operation.

2. The service switching device as claimed in claim 1, wherein the latching lever is mounted in an enclosure such that it can rotate at one end to the latching point.

3. The service switching device as claimed in claim 2, wherein the latching lever is mounted in only one enclosure half-shell.

4. The service switching device as claimed in claim 2, wherein the latching lever is guided by the lug, and is held in a bearing point in a first enclosure half-shell.

5. The service switching device as claimed in claim 2, wherein a projection in the form of a pin is integrally formed on each of the two sides of the latching lever, and is used for mounting it in one enclosure half-shell.

6. The service switching device as claimed in claim 5, wherein the lug has an aperture through which one of the projections on the latching lever passes, so that the latching lever is also mounted by its projection in an other enclosure half-shell.

7. The service switching device as claimed in claim 5, wherein one projection, on that side of the lug which is opposite the front wall, extends into an other enclosure half-shell.

8. The service switching device as claimed in claim 1, wherein a tab which projects in the direction of the tripping lever is formed on the lug, strikes against the tripping lever during the disconnection process, and drives the tripping lever to its limit position.

9. An electrical service switching device, comprising;

a switching mechanism with a latching point unlatched manually by a switching toggle or by an electromagnetic or thermal release, the switching toggle including a switching handle;

a tripping lever operated by the electromagnetic and thermal release and acting on the latching point;

a latching lever which forms one element of the latching point; and a movable contact lever which pivots, wherein the latching lever together with the tripping lever forms the latching point, the tripping lever is mounted such that it can rotate on a same rotation axis as the switching toggle, a projection which holds a first limb of a U-bracket is integrally formed on the switching toggle, opposite the switching handle, a second limb of the U-bracket is guided such that it can move in an elongated hole in the latching lever and is connected in an articulated manner to a connecting lug, whose other end is connected to the contact lever, wherein the latching lever runs approximately parallel to the connecting lug and alongside it, the connecting lug together with the latching lever forming an obtuse angle which is open in the direction of a front face of the switching device, only in a connected state, and the connecting lug being moved approximately parallel to the latching lever and approximately parallel to the front face in the direction of the latching point during a disconnection switching operation.

10. The electrical service switching device as claimed in claim 9 being used as one of a circuit breaker, a residual current device or a motor circuit breaker.

11. The service switching device as claimed in claim 7, wherein a tab which projects in the direction of the tripping lever is formed on the lug, strikes against the tripping lever during the disconnection process, and drives the tripping lever to its limit position.

12. The electrical service switching device according to claim 1, wherein the tripping lever is mounted such that it rotates separately on the same rotation axis as the switching toggle.

13. The electrical service switching device according to claim 9, wherein the tripping lever is mounted such that it rotates separately on the same rotation axis as the switching toggle.

* * * * *